US005757947A

United States Patent [19]

Van Halteren et al.

[11] Patent Number: 5,757,947

[45] Date of Patent: May 26, 1998

[54] TRANSDUCER

[75] Inventors: A. Z. Van Halteren, Hobrede; Onno Geschiere, Amsterdam, both of Netherlands

[73] Assignee: Microtronic Nederland, B.V., Amsterdam, Netherlands

[21] Appl. No.: 685,862

[22] Filed: Jul. 24, 1996

[30] Foreign Application Priority Data

Jul. 24, 1995 [NL] Netherlands ..... 1000880

[51] Int. Cl.[6] ..... H04R 25/00

[52] U.S. Cl. ..... 381/200; 381/69

[58] Field of Search ..... 381/200, 199, 381/194, 68, 69, 192; 29/594, 607.2

[56] References Cited

U.S. PATENT DOCUMENTS

| | | | |
|---|---|---|---|
| 3,111,563 | 11/1963 | Carlson | 381/200 |
| 3,588,383 | 6/1971 | Carlson . | |
| 3,617,653 | 11/1971 | Tibbetts | 381/200 |
| 3,935,398 | 1/1976 | Carlson et al. . | |
| 4,272,654 | 6/1981 | Carlson . | |
| 4,518,831 | 5/1985 | Stanley et al. . | |

FOREIGN PATENT DOCUMENTS 2229339 9/1990 United Kingdom .

OTHER PUBLICATIONS

PCT/GB93/02140—International Filing Date: 15 Oct. 1993; International Publication No. WO 94/1817; Inventors/Applicants (for US only): Salvage, R.J., Harrington, S.J.

*Primary Examiner*—Huyen D. Le

*Attorney, Agent, or Firm*—Birch, Stewart, Kolasch & Birch, LLP

[57] ABSTRACT

A transducer, in particular suitable for hearing aids, comprising a coil, two spaced magnet elements, a membrane, and an E-shaped armature, a middle leg of the E-shaped armature extending through the coil and the two magnet elements and being coupled with the membrane by means of a connecting element, limiting means being provided for limiting the maximum deflection of the middle leg of the E-shaped armature, which limiting means cooperate with the end of the middle leg of the E-shaped armature.

16 Claims, 3 Drawing Sheets

TRANSDUCER

This invention relates to a transducer, in particular suitable for hearing aids, comprising a coil, two spaced magnet elements, a membrane, and an E-shaped armature, a middle leg of the E-shaped armature extending through the coil and the two magnet elements and being coupled with the membrane by means of a connecting element, and limiting means being provided for limiting the maximum deflection of the middle leg of the E-shaped armature.

BACKGROUND OF THE INVENTION

The above-described transducer is known, e.g., from patent application WO 94/10817. This publication describes a transducer in which the limiting means cooperate with the, seen in the longitudinal direction, central portion of the middle leg of the E-shaped armature, in order to limit the maximally possible deflection of the middle leg, thus increasing the shock resistance of the transducer. The limiting means may comprise elevated and lowered portions of the middle leg, individual elements disposed on the middle leg or individual elements reducing the space between the two magnets and/or of the coil near the central portion of the middle leg. Moreover, mention is made of the possibility of reducing the interspace of the two magnet elements and/or the coil.

This known transducer, however, has the drawback that providing the above limiting means is laborious and is expensive in case no standard parts can be used. A further drawback arises when an amplifier is built in. The space necessary therefor is obtained by considerably shortening the coil. This involves the risk that the limiting means on the armature partially fall outside the coil.

SUMMARY OF THE INVENTION

It is the object of the invention to provide a solution to the above problem. To this end, the invention provides a transducer of the above type, characterized in that the limiting means cooperate with the end of the middle leg of the E-shaped armature.

By taking the steps of the invention, a transducer is provided which, on the one hand, can be produced in an easy and inexpensive manner and, on the other hand, has the very important advantage that the limiting means engage with the middle leg of the E-shaped armature on the location where, in case of a shock, the largest deflection takes place.

An transducer which can be produced in a very easy and inexpensive manner is obtained if the limiting means are disposed on the connecting element. To this end, the connecting element comprises a connecting piece affixed to the middle leg of the armature. The connecting piece may be C- or O-shaped, in such a manner that the connecting piece is slidable over a projection of the middle leg of the armature and can thus be easily coupled therewith. The limiting means comprise wall portions disposed on both sides of the connecting piece, which provides the advantage that, in case of a strong impact or shock, the force is absorbed substantially by the wall portions and is transmitted to the middle leg of the armature only via the connecting piece. Moreover, the connecting piece may be substantially I-shaped, the width of the connecting piece corresponding substantially to the thickness of the middle leg of the armature. Here the limiting means comprise wall portions disposed on the upper and lower sides of the connecting piece, the degree of limitation being determined by the thickness of the material of these wall portions. A transducer which can be produced very easily with one of the above embodiments of the connecting pieces is obtained if the connecting element is formed integral and is, e.g., an etching product.

Another possibility of limiting the maximum deflection of the middle leg consists in that limiting means are provided on the side of the magnet elements facing away from the coil. Hereby it is very advantageous if the limiting means comprise a U-shaped element of which, preferably, the legs on the sides facing each other taper towards each other in the direction of the base of the U-shaped element. This type of limitation has the advantage that the U-shaped element can be mounted in the right position after magnetization of the transducer and adjustment of the middle leg of the E-shaped armature relative to the magnet elements and the coil. Because of variations in the production of the coil and/or the magnet elements, there is a great risk that the limiting means are not disposed symmetrically with respect to the space determined by the magnet elements and the coil, with the result that the shock resistance in one direction will be inferior to that in the other direction. In another embodiment the legs of the U-shaped element are provided on the sides facing each other with aligned projections, in order to reduce the risk that a side edge of the middle leg of the armature, when in a slightly inclined position, strikes the sides facing each other.

BRIEF DESCRIPTION OF THE DRAWINGS

The invention will be explained below in more detail by means of a number of exemplary embodiments with reference to the accompanying drawings, in which.

DETAILED DESCRIPTION OF THE INVENTION

Figure 1:
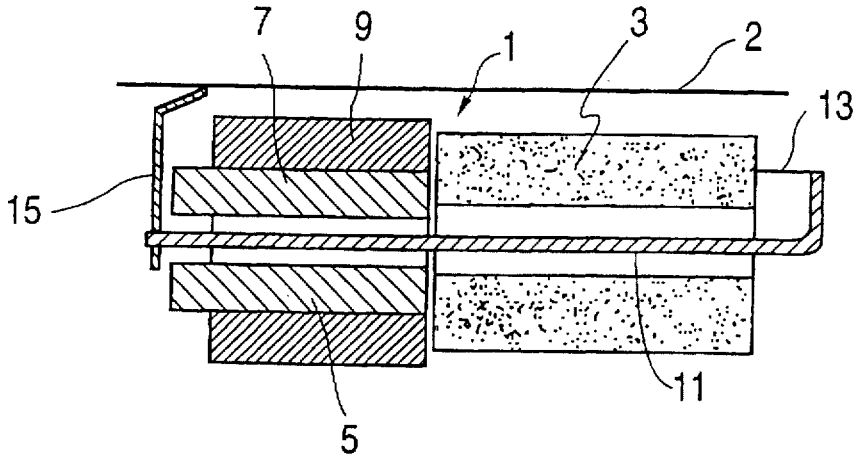
FIG. 1 is a cross-sectional view of a transducer having an E-shaped armature.

In the Figures, similar parts are indicated by the same reference numerals. FIG. 1 shows a transducer 1 according to the state of the art. The transducer 1 comprises a coil 3 and two spaced magnet elements 5, 7, which may also be formed by an annular magnet and are placed in a magnet casing 9. A middle leg 11 of an E-shaped armature 13 extends through the coil 3 and the two magnet elements 5, 7. Further details concerning the structure and operation of an E-shaped armature in general are given in WO-A-94/10817. The end of the middle leg 11 of the E-shaped armature 13 is connected with a membrane 2 by means of a connecting element 15. The transducer operates as follows: The output signal of an amplifier, not shown, is transmitted to the coil 3, thus vibrating the middle leg 11 of the armature 13 in cooperation with the permanent magnetic field of the magnet elements 5, 7. The vibrating movements of the middle leg 11 of the armature 13 are then transmitted via the connecting element 15 to the membrane, not shown.

Figure 2:
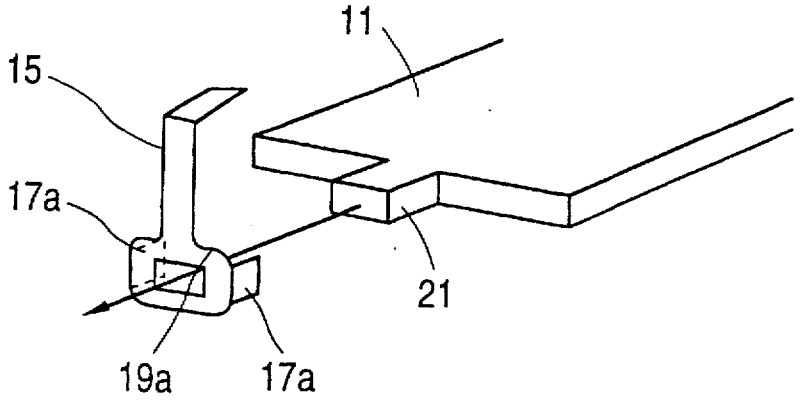
FIG. 2 is a perspective side elevational view of a first embodiment of a transducer according to the invention.

FIG. 2 is a perspective side elevational view of a first embodiment of a transducer 1 having limiting means for limiting the maximum deflection of the middle leg 11 of the E-shaped armature 13, thus increasing the shock resistance of the transducer 1. To this end, the connecting element 15 (which is connected to membrane 2) has a connecting piece 19*a* which is substantially O-shaped and has, on both sides thereof, substantially rectangular wall portions 17*a* forming the limiting means. The rectangular wall portions 17*a* have a height exceeding the thickness of the middle leg 11 of the E-shaped armature 13. The middle leg 11 of the E-shaped armature 13 has, at its end, a projection 21, over which the O-shaped connecting piece 19*a* of the connecting element 15 is slidable, in such a manner that the rectangular wall portions 17*a* are at least partially located in the space between the two magnet elements 5, 7, so that an excessive deflection of the middle leg 11 of the armature 13 beyond the bending limit thereof can be prevented.

Figure 3:
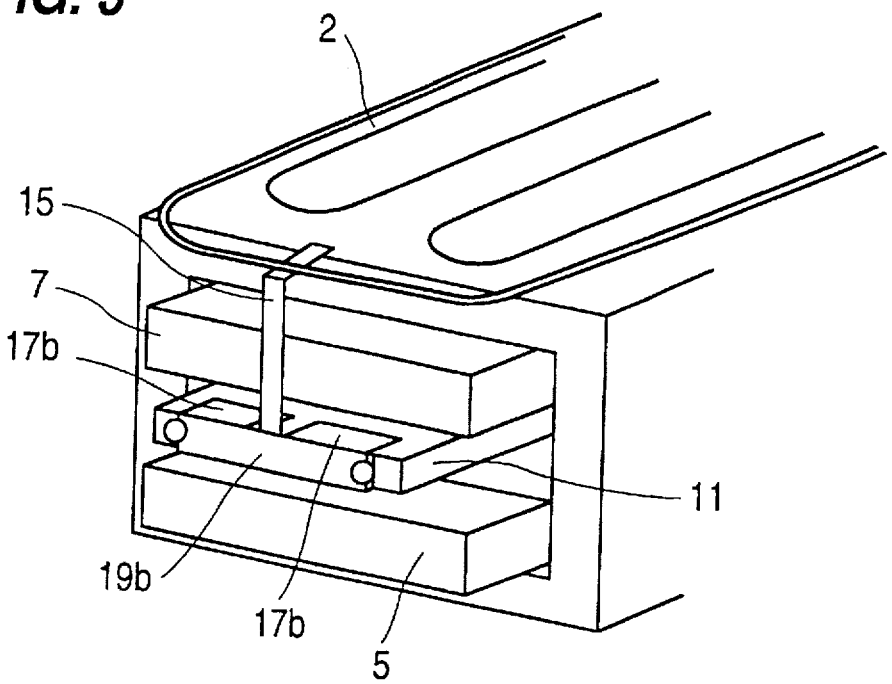
FIG. 3 is a perspective side elevational view of a second embodiment of a transducer according to the invention.

FIG. 3 is a perspective side elevational view of a second embodiment of a transducer 1 having limiting means. The connecting piece 19*b* is substantially I-shaped and is welded or glued to the middle leg 11 of the E-shaped armature 13, the width of the I-shaped connecting piece 19*b* corresponding substantially to the thickness of the middle leg 11. The limiting means comprise substantially rectangular wall portions 17*b* disposed on the upper and lower sides of the I-shaped connecting piece 19*b*, the thickness of these wall portions determining the maximally possible deflection of the middle leg 11. A very simple embodiment of the transducer shown in FIG. 2 or 3 is obtained if the connecting element 15 is formed integral with the connecting piece 19*a* or 19*b* and the limiting means 17*a* or 17*b*, respectively, and is, e.g., an etching product.

Figure 4:
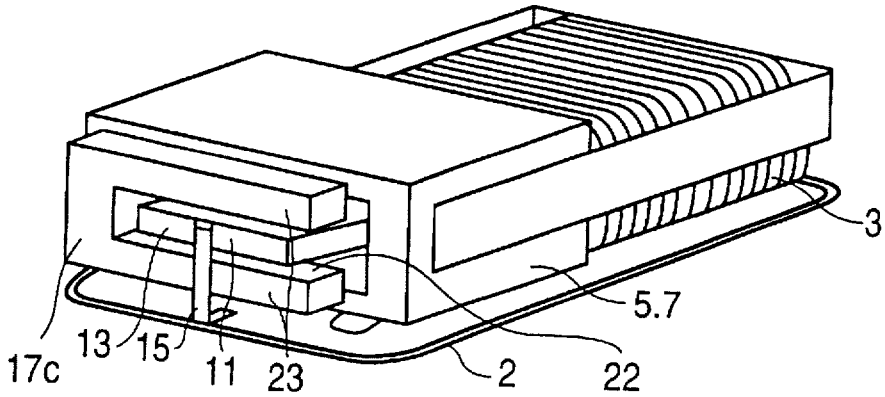
FIG. 4 is a perspective side elevational view of a third embodiment of a transducer according to the invention.

FIG. 4 shows another variant, in which the limiting means comprise a U-shaped element 17*c* disposed on the side of the magnet elements 5, 7 facing away from the coil 3. The end of the middle leg 11 extends beyond the end faces of the magnet elements 5, 7, in such a manner that the end portion of the middle leg 11 is at least partially located between the sides 21 of the legs 23 of the U-shaped element 17*c* facing each other, so that the maximum deflection of the middle leg 11 can be limited by these sides 21. To center the U-shaped element 17*c* with respect to the middle leg 11, it is very advantageous if the sides 22 of the U-shaped element 17*c* facing each other taper towards each other in the direction of the base thereof. The U-shaped element 17*c* is thus placed and fastened on the side of the magnet elements 5, 7 facing away from the coil 3, e.g. by means of a hardening glue, after magnetization of the transducer 1 and adjustment of the middle leg 11.

Figure 5:
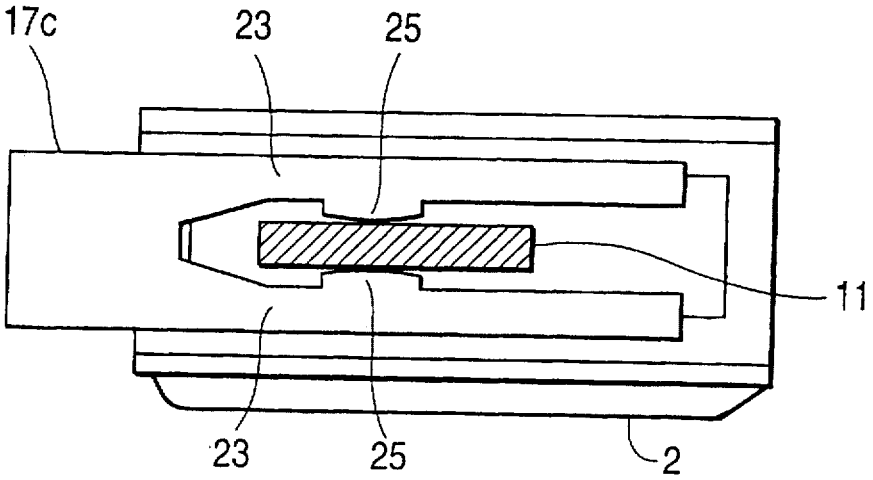
FIG. 5 is a front elevational view of a special embodiment of the U-shaped element shown in FIG. 4 with the armature accommodated therein.

FIG. 5 is a front elevational view of a special embodiment of the U-shaped element 17*c* shown in FIG. 4 with the middle leg 11 of the E-shaped armature 13 accommodated therein. The legs 23 of the U-shaped element 17*c* are provided on the sides facing each other with aligned projections 25. These projections 25 reduce the risk that the middle leg 11 of the armature 13, when in a slightly inclined position, strikes the sides facing each other and also limit the maximum deflection of the middle leg 11.

It is self-evident that many modifications and variants are possible within the scope of the invention. Thus, e.g., the space formed by the magnet elements or the coil may also be reduced, in such a manner that the limiting means are then formed by the side wall portions facing inwards. Also, the limiting means may comprise only one rectangular wall portion 17*a*. Moreover, the limiting means shown in FIG. 3 may only be formed by one rectangular wall portion 17*b* disposed on the lower side of the connecting piece 19*b*. The projection 21 is not really necessary for the embodiment shown in FIG. 2. The connecting piece 19*a* may also be of such construction that it can be slid over the entire width of the middle leg 11. The limiting means shown in FIGS. 4 and 5 may, e.g., also be O-shaped, instead of U-shaped.

We claim:

1. A transducer, in particular suitable for hearing aids, comprising a coil, two spaced magnet elements, a membrane, and an E-shaped armature, a middle leg of the E-shaped armature extending through the coil and a space between the two magnet elements and being coupled with the membrane by means of a connecting element, and limiting means being provided for limiting the maximum deflection of the middle leg of the E-shaped armature, wherein the limiting means is directly connected to the connecting element at a distal end of the middle leg of the E-shaped armature, and is at least partially disposed in the space between the magnet elements.

2. A transducer according to claim 1, wherein the connecting element comprises a connecting piece affixed to the middle leg of the armature.

3. A transducer according to claim 2, wherein the connecting piece is substantially C- or O-shaped, in such a manner that the connecting piece is slidable over the middle leg of the armature.

4. The transducer according to claim 3, wherein the limiting means comprise wall portions disposed on both sides of the connecting piece.

5. A transducer according to claim 2, wherein the limiting means comprise wall portions disposed on both sides of the connecting piece.

6. A transducer according to claim 2, wherein the connecting piece is substantially I-shaped, in such a manner that the width of the connecting piece corresponds substantially to the thickness of the middle leg of the armature.

7. The transducer according to claim 6, wherein the limiting means comprise wall portions disposed on the upper and lower sides of the connecting piece.

8. A transducer according to claim 2, wherein the limiting means comprise wall portions disposed on the upper and lower sides of the connecting piece.

9. A transducer according to claim 2, wherein the connecting element is formed integral with the connecting piece and the limiting means.

10. A transducer according to claim 9, wherein the connecting element with the connecting piece and the limiting means is an etching product.

11. A transducer according to claim 1, wherein the distance of the two magnet elements relative to each other is reduced.

12. A transducer, in particular suitable for hearing aids, comprising a coil, two spaced magnet elements, a membrane, and an E-shaped armature, a middle leg of the E-shaped armature extending through the coil and the two magnet elements and being coupled with the membrane by means of a connecting element, and limiting means being provided for limiting the maximum deflection of the middle leg of the E-shaped armature, wherein the limiting means is affixed onto a side of the magnet elements facing away from the coil and between the connecting element and the magnet elements at a distal end of the middle leg of the E-shaped armature.

13. A transducer according to claim 12, wherein the limiting means comprise a U-shaped element.

14. A transducer according to claim 13, wherein the legs of the U-shaped element on the sides facing each other taper towards each other in the direction of the base of the U-shaped element.

15. The transducer according to claim 14, wherein the legs of the U-shaped element are provided on the side facing each other with aligned projections.

16. A transducer according to claim 13, wherein the legs of the U-shaped element are provided on the sides facing each other with aligned projections.

* * * * *